US010147376B2

(12) United States Patent
Wu

(10) Patent No.: US 10,147,376 B2
(45) Date of Patent: Dec. 4, 2018

(54) COMMON ELECTRODE DRIVING MODULE AND LIQUID CRYSTAL DISPLAY PANEL

(71) Applicant: Shenzhen China Star Optoelectronics Technology Co., Ltd., Shenzhen, Guangdong (CN)

(72) Inventor: Yu Wu, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 182 days.

(21) Appl. No.: 15/114,057

(22) PCT Filed: Jun. 21, 2016

(86) PCT No.: PCT/CN2016/086535

§ 371 (c)(1),
(2) Date: Jul. 25, 2016

(87) PCT Pub. No.: WO2017/210921

PCT Pub. Date: Dec. 14, 2017

(65) Prior Publication Data

US 2017/0372671 A1 Dec. 28, 2017

(30) Foreign Application Priority Data

Jun. 6, 2016 (CN) ..... 2016 1 0395604

(51) Int. Cl.
*G09G 3/36* (2006.01)

(52) U.S. Cl.
CPC ..... *G09G 3/3655* (2013.01); *G09G 3/3677* (2013.01); *G09G 2300/0426* (2013.01);
(Continued)

(58) Field of Classification Search
CPC ..... G09G 3/3655; G09G 2300/0876
See application file for complete search history.

(56) References Cited

U.S. PATENT DOCUMENTS

2002/0041281 A1* 4/2002 Yanagi ..... G09G 3/3648 345/212
2003/0058204 A1* 3/2003 Moon ..... G09G 3/3655 345/87

(Continued)

FOREIGN PATENT DOCUMENTS

CN 1423251 A 6/2003
CN 1499474 A 5/2004

(Continued)

*Primary Examiner* — Kevin M Nguyen
(74) *Attorney, Agent, or Firm* — Andrew C. Cheng

(57) ABSTRACT

A common electrode driving module is provided to provide different common voltages according to different display modes of an LCD panel. The common electrode driving module includes a voltage-division resistor string configured to obtain an input voltage, a switch selecting unit electrically connected to the voltage-division resistor string configured to change an voltage level of the input voltage by controlling on/off states of the switches to change a number of resistors contained in the voltage voltage-division resistor string, a voltage amplifying unit configured to amplify the input voltage to generate the common voltage and provide the common voltage to the common electrode, and a mode switching unit, configured to provide a control signal to the switch selecting unit to control the on/off states of the at least one switch according to a current display mode such that the common voltage corresponding to the current display mode is obtained.

10 Claims, 2 Drawing Sheets

(52) U.S. Cl.
CPC ..... *G09G 2310/0281* (2013.01); *G09G 2320/0219* (2013.01); *G09G 2320/0223* (2013.01)

(56) References Cited

U.S. PATENT DOCUMENTS

| | | | | |
|---|---|---|---|---|
| 2005/0140400 | A1 | 6/2005 | Yi | |
| 2006/0152460 | A1* | 7/2006 | Toyozawa ..... | G09G 3/3648 345/98 |
| 2012/0212471 | A1* | 8/2012 | Abe ..... | G09G 3/3648 345/211 |

FOREIGN PATENT DOCUMENTS

| | | | |
|---|---|---|---|
| CN | 1746964 | A | 3/2006 |
| CN | 1788304 | A | 6/2006 |
| CN | 101739978 | A | 6/2010 |
| CN | 101847376 | A | 9/2010 |
| CN | 104376820 | A | 5/2015 |
| KR | 10-2008-0078454 | A | 8/2008 |

* cited by examiner

COMMON ELECTRODE DRIVING MODULE AND LIQUID CRYSTAL DISPLAY PANEL

BACKGROUND OF THE INVENTION

1. Field of the Invention

The invention relates to a liquid crystal display (LCD), and more particularly, to a common electrode driving module and a related LCD panel.

2. Description of the Prior Art

Liquid Crystal Display (LCD) has been widely used because of its thin, power saving, and non-radiative characteristics. For example, LCDs are adopted in all kinds of electronic equipments, such as cell phones or tablets.

The driving system of an LCD comprises a common electrode driving module. Conventionally, the common electrode driving module is capable of providing only one common voltage (Vcom). As the performance of LCDs becomes more and more efficient and comprehensive, a driving system often has different display modes, such as 2D@60 Hz, 2D@120 Hz, and 3D@120 Hz (or 3D@240 Hz). Because each display mode has its own charging time, different display modes needs different common voltages (Vcom). Therefore, the conventional common electrode driving module cannot meet the aforementioned demands because the conventional common electrode driving module can provide only one common voltage.

SUMMARY OF THE INVENTION

It is therefore one of the primary objectives of the claimed invention to provide a common voltage driving module capable of providing different common voltages to the LCD panel according to the display mode.

According to an exemplary embodiment of the claimed invention, a common voltage driving module capable of providing a common voltage to a common electrode of a liquid crystal display (LCD) panel supporting a plurality of display modes is provided. The common voltage driving module comprises: a voltage-division resistor string, configured to receive a voltage source and divide the voltage source to obtain an input voltage; a switch selecting unit, electrically connected to the voltage-division resistor string, the switch selecting unit comprising at least one switch, the switch selecting unit being configured to change an voltage level of the input voltage by controlling on/off states of the at least one switch to change a number of resistors contained in the voltage voltage-division resistor string; a voltage amplifying unit, configured to amplify the input voltage to generate the common voltage and provide the common voltage to the common electrode; and a mode switching unit, configured to provide a control signal to the switch selecting unit to control the on/off states of the at least one switch according to a current display mode such that the common voltage corresponding to the current display mode is obtained.

In one aspect of the present invention, the voltage-division resistor string comprises a plurality of variable resistors connected in series.

In another aspect of the present invention, a relationship between the common voltage (Vcom) and the input voltage (Vin) is: $Vcom=K\times Vin$, wherein K is a constant.

In another aspect of the present invention, the switch is a Metal-Oxide-Semiconductor Field-Effect Transistor (MOSFET), wherein a gate of the MOSFET receives the control signal, a source of the MOSFET is electrically connected to a ground, and a drain of the MOSFET is electrically connected to the voltage-division resistor string.

In another aspect of the present invention, the voltage-division resistor string comprises a first resistor, a second resistor, and a third resistor, which are connected in series, the switch selecting unit comprises a first MOSFET and a second MOSFET, a first end of the first resistor receives the voltage source, a second end of the first resistor is electrically connected to a first end of the second resistor, a second end of the second resistor is electrically connected to a first end of the third resistor, a gate of the first MOSFET receives a first control signal, a source of the first MOSFET is electrically connected to the ground, a drain of the first MOSFET is electrically connected to the second end of the second resistor, a gate of the second MOSFET receives a second control signal, a source of the second MOSFET is electrically connected to the ground, a drain of the second MOSFET is electrically connected to a second end of the third resistor, and the input voltage is obtained from a node between the second end of the first resistor and the first end of the second resistor.

In still another aspect of the present invention, the first control signal and the second control signal are capable of being a high voltage level or a low voltage level, and a combination of voltage levels of the first control signal and the second control signal represents different display modes.

In yet another aspect of the present invention, the node is electrically connected to the ground through a capacitor.

According to an exemplary embodiment of the claimed invention, a liquid crystal display panel is provided. The LCD display comprises: a display panel; a source driving module, configured to provide a data signal to the display panel; a gate driving module, configured to provide a scan signal to the display panel; and the aforementioned common electrode driving module, configured to provide a common voltage to the display panel.

In contrast to the related art, the common electrode driving module according to an exemplary embodiment can provide different common voltages to the common electrode of the LCD panel according to different display modes. Therefore, the demands for supporting different display modes can be met. This characteristic allows the LCD panel to optimally display images in every display mode and thus the performance of the LCD panel is raised.

DETAILED DESCRIPTION OF THE PREFERRED EMBODIMENT

These and other objectives of the claimed invention will no doubt become obvious to those of ordinary skill in the art after reading the following detailed description of the preferred embodiment that is illustrated in the various figures and drawings.

For better understanding embodiments of the present invention, the following detailed description taken in conjunction with the accompanying drawings is provided. Apparently, the accompanying drawings are merely for some of the embodiments of the present invention. Any ordinarily skilled person in the technical field of the present invention could still obtain other accompanying drawings without use laborious invention based on the present accompanying drawings.

Figure 1:
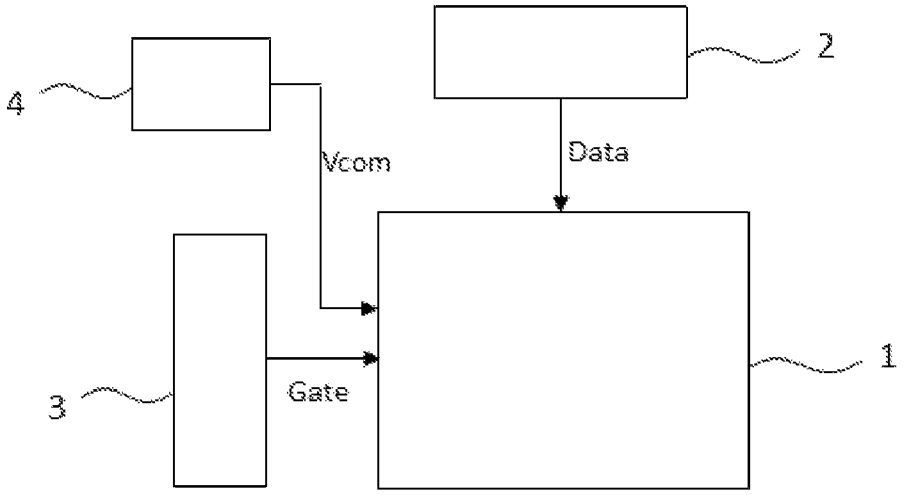
FIG. 1 is a functional block diagram of an LCD panel according to an exemplary embodiment.

Please refer to FIG. 1, which is a functional block diagram of an LCD panel according to an exemplary embodiment of the present disclosure. As shown in FIG. 1, the LCD panel comprises a display panel 1, a source driving module 2, a gate driving module 3, and a common electrode driving module 4. The display panel 1 comprises a plurality of scan lines and a plurality of data lines perpendicular to the scan lines. In addition, a plurality of pixels (not shown) are arranged in the intersections of the data lines and the scan lines. The source driving module 2 provide data signals (Data) to the display panel 1 through the data lines. The gate driving module 3 provides scan signals (Gate) to the display panel 1 through the scan lines. The common electrode driving module 4 is used to provide a common voltage (Vcom) to the common electrode of the display panel 1.

In this exemplary embodiment, the LCD display panel has a plurality of display modes, such as 2D@60 Hz, 2D@120 Hz, and 3D@120 Hz (or 3D@240 Hz). In order to satisfy the demands of supporting these display modes, the common electrode driving module 4 can provide different common voltages according to different display modes.

Figure 2:
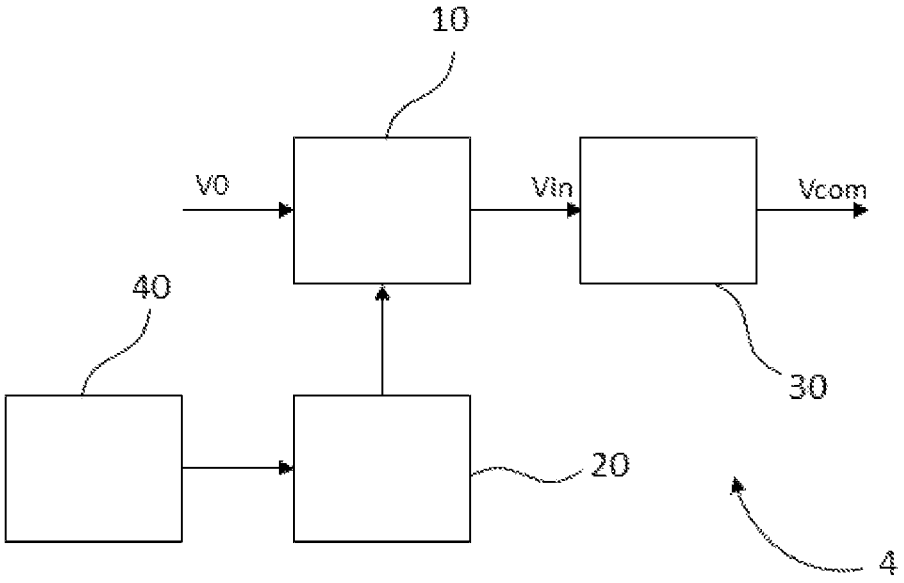
FIG. 2 is a functional block diagram of a common electrode driving module according to an exemplary embodiment.

Please refer to FIG. 2. FIG. 2 is a functional block diagram of a common electrode driving module according to an exemplary embodiment. As shown in FIG. 2, the common electrode driving module 4 comprises a voltage-division resistor string 10, a switch selecting unit 20, a voltage amplifying unit 30, and a mode switching unit 40.

The voltage-division resistor string 10 comprises a plurality of resistors connected in series. These resistors may be implemented with variable resistors. The voltage-division string 10 receives a voltage source V0 and divides the voltage source V0 to obtain an input voltage Vin.

The switch selecting unit 20 is electrically connected to the voltage-division resistor string 10. The switch selecting unit 20 is used to control the number of the resistors contained in the voltage-division resistor string 10 to change the voltage level of the input voltage Vin obtained from the voltage-division resistor string 10. Specifically, the switching selecting unit 20 comprises at least one switch. The switch selecting unit 20 changes the number of the resistors contained in the voltage-division resistor string 10 through controlling the on/off states of the at least one switch such that input voltage Vin having different voltage levels can be obtained.

The voltage amplifying unit 30 is used to amplify the input voltage Vin into the common voltage Vcom and provide the common voltage Vcom to the common electrode. The voltage amplifying unit 30 is mainly used to amplify the voltage. In this embodiment, the relationship between the common voltage Vcom and the input voltage Vin is: Vcom=K×Vin. Here, K is a constant, representing an amplifying coefficient.

The mode switching unit 40 is used to provide a control signal to the switch selecting unit 20 according to the current display mode to control the on/off states of the at least one switch of the switch selecting unit 20 to obtain a common voltage Vcom corresponding to the current display mode. Specifically, the mode switching unit 40 can be integrated in the timing controller (Tcon). In addition, the mode switching unit 40 can detect the current display mode of the LCD panel and provide a control signal corresponding to the current display mode to the switching selecting unit 20 to further control the on/off states of the at least one switch of the switch selecting unit 20 such that a common voltage Vcom corresponding to the current display mode is obtained.

In this embodiment, the aforementioned switch is a Metal-Oxide-Semiconductor Field-Effect Transistor (MOSFET). The gate of the MOSFET receives the control signal, the source of the MOSFET is electrically connected to the ground, and the drain of the MOSFET is electrically connected to the voltage-division resistor string. In another embodiment, the switch may be implemented with a Bipolar Junction Transistor (BJT).

Figure 3:
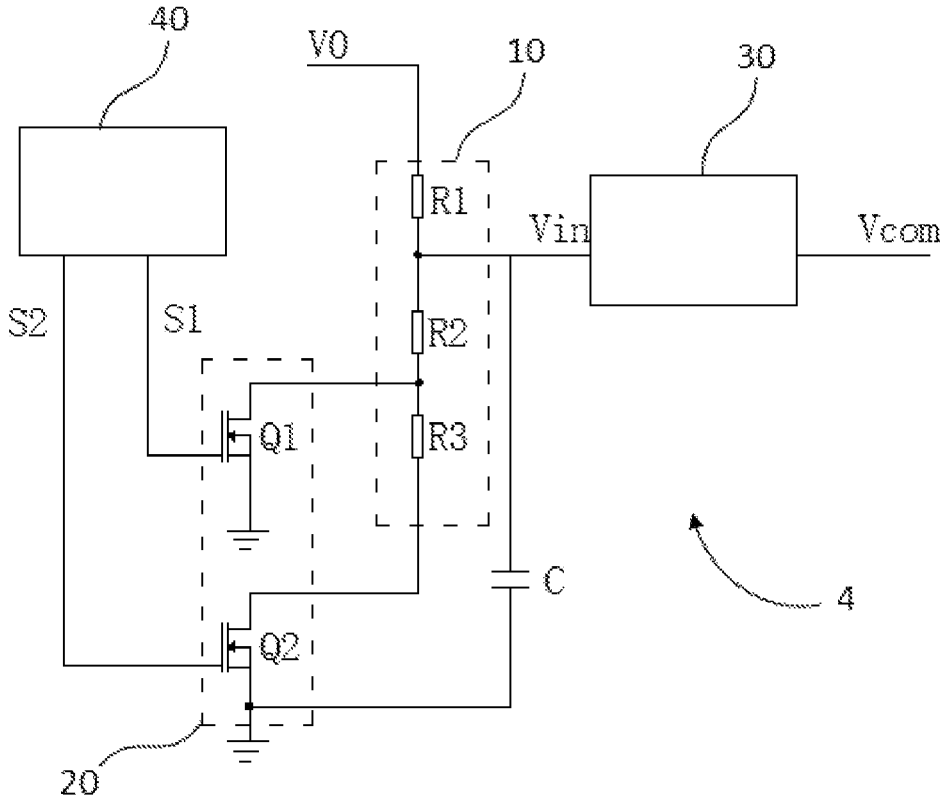
FIG. 3 is a circuit diagram of a common electrode driving module according to an exemplary embodiment.

Please refer to FIG. 3. FIG. 3 is a circuit diagram of a common electrode driving module according to an exemplary embodiment. As shown in FIG. 3, the voltage-division resistor string 19 comprises a first resistor R1, a second resistor R2, and a third resistor R3, which are connected in series. The switch selecting unit 20 comprises a first MOSFET Q1 and a second MOSFET Q2. The first end of the first resistor R1 receives the voltage source V0. The second end of the first resistor R1 is electrically connected to the first end of the second resistor R2. The second end of the second resistor R2 is electrically connected to the first end of the third resistor R3. The gate of the first MOSFET Q1 receives a first control signal S1. The source of the first MOSFET Q1 is electrically connected to the ground. The drain of the first MOSFET Q1 is electrically connected to the second end of the second resistor R2. The gate of the second MOSFET Q2 receives a second control signal S2. The source of the second MOSFET Q2 is electrically connected to the ground. The drain of the second MOSFET Q2 is electrically connected to the second end of the third resistor. R3. The input voltage Vin is obtained from a node between the second end of the first resistor R1 and the first end of the second resistor R2. The first control signal S1 and the second control signal S2 are generated by the mode switching unit 40. The input voltage Vin is amplified by the voltage amplifying unit 30 into the common voltage Vcom.

The first control signal S1 and the second control signal S2 can correspond to a high voltage level or a low voltage level. In addition, the combination of voltage levels of the first control signal and the second control signal represents different display modes. In the following disclosure, the combination will be illustrated in conjunction with FIG. 3.

Mode 1: The mode switching unit 40 sets the first control signal S1 and the second control signal S2 be corresponding to the low voltage level. The first MOSFET Q1 and the second MOSFET Q2 are turned off. At this time, the voltage-division resistor string 10 is not grounded. The input voltage Vin is equal to the voltage source V0. The input voltage Vin is amplified by the voltage amplifying unit 30 to become a common voltage Vcom having a first voltage level, which corresponds to Mode 1 (such as 2D@60 Hz).

Mode 2: The mode switching unit 40 sets the first control signal S1 as a high voltage level and the second control signal S2 as a low voltage level. At this time, the first MOSFET Q1 is turned on and the second MOSFET Q2 is turned off. Therefore, the second end of the second resistor R2 is grounded through the first MOSFET Q1. The input voltage Vin is a divided voltage of the voltage source V0 because of the first resistor R1 and the second resistor R2. Specifically, Vin=V0×R2/(R1+R2). Furthermore, the voltage amplifying unit 30 amplifies the input voltage Vin to generate a common voltage Vcom having a second voltage level, which corresponds to Mode 2 (such as 2D@120 Hz).

Mode 3: The mode switching unit 40 sets the first control signal S1 as a low voltage level and the second control signal S2 as a high voltage level. At this time, the first MOSFET Q1 is turned off and the second MOSFET Q2 is turned on. Therefore, the second end of the second resistor R2 is not grounded. The second end of the third resistor R3 is grounded through the second MOSFET Q2. The input voltage Vin is a divided voltage of the voltage source V0 because of the first resistor R1, the second resistor R2, and the third resistor R3. Specifically, Vin=V0×(R2+R3)/(R1+R2+R3). Furthermore, the voltage amplifying unit 30 amplifies the input voltage Vin to generate a common voltage Vcom having a third voltage level, which corresponds to Mode 3 (such as 3D@240 Hz).

Furthermore, as shown in FIG. 3, the node between the second end of the first resistor R1 and the first end of the second resistor R2 is electrically connected to the ground through a capacitor C, which is used to raise the stability of the input voltage.

To sum up, the common electrode driving module according to an exemplary embodiment can provide different common voltages to the common electrode of the LCD panel according to different display modes. Therefore, the demands for supporting different display modes can be met. This characteristic allows the LCD panel to optimally display images in every display mode and thus the performance of the LCD panel is raised.

Moreover, despite one or more implementations relative to the present disclosure being illustrated and described, equivalent alterations and modifications will occur to others skilled in the art upon reading and understanding this specification and the annexed drawings. The present disclosure comprises such modifications and variations, and is to be limited only by the terms of the appended claims. In particular, regarding the various functions performed by the above described components, the terms used to describe such components (i.e. elements, resources, etc.) are intended to correspond (unless otherwise indicated) to any component, which performs the specified function of the described component (i.e., that is, functionally equivalent), even though not structurally equivalent to the disclosed structure which performs the function in the illustrated implementations of the disclosure. In addition, although a particular feature of the disclosure may have been disclosed with respect to only one of several implementations, such a feature may be combined with one or more other features of the other implementations as may be desired and advantageous for any given or particular application. Also, to the extent that the terms "including", "includes", "having", "has", "with", or variants thereof are used in the detailed description or in the claims, such terms are intended to be inclusive in a manner similar to the term "comprising".

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A common voltage driving module, capable of providing a common voltage to a common electrode of a liquid crystal display (LCD) panel supporting a plurality of display modes, the common voltage driving module comprising:

a voltage-division resistor string, configured to receive a voltage source and divide the voltage source to obtain an input voltage;

a switch selecting unit, electrically connected to the voltage-division resistor string, the switch selecting unit comprising at least one switch, the switch selecting unit being configured to change an voltage level of the input voltage by controlling on/off states of the at least one switch to change a number of resistors contained in the voltage voltage-division resistor string; and a voltage amplifying unit, configured to amplify the input voltage to generate the common voltage and provide the common voltage to the common electrode;

a mode switching unit, configured to provide a control signal to the switch selecting unit to control the on/off states of the at least one switch according to a current display mode such that the common voltage corresponding to the current display mode is obtained;

wherein the switch is a Metal-Oxide-Semiconductor Field-Effect Transistor (MOSFET), wherein a gate of the MOSFET receives the control signal, a source of the MOSFET is electrically connected to a ground, and a drain of the MOSFET is electrically connected to the voltage-division resistor string; and wherein the voltage-division resistor string comprises a first resistor, a second resistor, and a third resistor, which are connected in series, the switch selecting unit comprises a first MOSFET and a second MOSFET, a first end of the first resistor receives the voltage source, a second end of the first resistor is electrically connected to a first end of the second resistor, a second end of the second resistor is electrically connected to a first end of the third resistor, a gate of the first MOSFET receives a first control signal, a source of the first MOSFET is electrically connected to the ground, a drain of the first MOSFET is electrically connected to the second end of the second resistor, a gate of the second MOSFET receives a second control signal, a source of the second MOSFET is electrically connected to the ground, a drain of the second MOSFET is electrically connected to a second end of the third resistor, and the input voltage is obtained from a node between the second end of the first resistor and the first end of the second resistor.

2. The common voltage driving module of claim 1, wherein the voltage-division resistor string comprises a plurality of variable resistors connected in series.

3. The common voltage driving module of claim 1, wherein a relationship between the common voltage (Vcom) and the input voltage (Vin) is: Vcom=K×Vin, wherein K is a constant.

4. The common electrode driving module of claim 1, wherein the first control signal and the second control signal are capable of being a high voltage level or a low voltage level, and a combination of voltage levels of the first control signal and the second control signal represents different display modes.

5. The common electrode driving module of claim 1, wherein the node is electrically connected to the ground through a capacitor.

6. A liquid crystal display panel, comprising:

a display panel;

a source driving module, configured to provide a data signal to the display panel;

a gate driving module, configured to provide a scan signal to the display panel; and a common electrode driving module, configured to provide a common voltage to the display panel, the common voltage driving module comprising:

a voltage-division resistor string, configured to receive a voltage source and divide the voltage source to obtain an input voltage;

a switch selecting unit, electrically connected to the voltage-division resistor string, the switch selecting unit comprising at least one switch, the switch selecting unit being configured to change an voltage level of the input voltage by controlling on/off states of the at least one switch to change a number of resistors contained in the voltage voltage-division resistor string;

a voltage amplifying unit, configured to amplify the input voltage to generate the common voltage and provide the common voltage to the common electrode; and a mode switching unit, configured to provide a control signal to the switch selecting unit to control the on/off states of the at least one switch according to a current display mode such that the common voltage corresponding to the current display mode is obtained;

wherein the switch is a Metal-Oxide-Semiconductor Field-Effect Transistor (MOSFET), wherein a gate of the MOSFET receives the control signal, a source of the MOSFET is electrically connected to a ground, and a drain of the MOSFET is electrically connected to the voltage-division resistor string; and wherein the voltage-division resistor string comprises a first resistor, a second resistor, and a third resistor, which are connected in series, the switch selecting unit comprises a first MOSFET and a second MOSFET, a first end of the first resistor receives the voltage source, a second end of the first resistor is electrically connected to a first end of the second resistor, a second end of the second resistor is electrically connected to a first end of the third resistor, a gate of the first MOSFET receives a first control signal, a source of the first MOSFET is electrically connected to the ground, a drain of the first MOSFET is electrically connected to the second end of the second resistor, a gate of the second MOSFET receives a second control signal, a source of the second MOSFET is electrically connected to the ground, a drain of the second MOSFET is electrically connected to a second end of the third resistor, and the input voltage is obtained from a node between the second end of the first resistor and the first end of the second resistor.

7. The liquid crystal display panel of claim 6, wherein the voltage-division resistor string comprises a plurality of variable resistors connected in series.

8. The liquid crystal display panel of claim 6, wherein a relationship between the common voltage (Vcom) and the input voltage (Vin) is: $Vcom=K\times Vin$, wherein K is a constant.

9. The liquid crystal display panel of claim 6, wherein the first control signal and the second control signal are capable of being a high voltage level or a low voltage level, and a combination of voltage levels of the first control signal and the second control signal represents different display modes.

10. The liquid crystal display panel of claim 6, wherein the node is electrically connected to the ground through a capacitor.

* * * * *